US008295724B2

(12) United States Patent
Takahashi

(10) Patent No.: US 8,295,724 B2
(45) Date of Patent: Oct. 23, 2012

(54) IMAGE FORMING APPARATUS

(75) Inventor: Masamitsu Takahashi, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 412 days.

(21) Appl. No.: 12/392,149

(22) Filed: Feb. 25, 2009

(65) Prior Publication Data

US 2009/0220267 A1 Sep. 3, 2009

(30) Foreign Application Priority Data

Feb. 29, 2008 (JP) ..... 2008-049491

(51) Int. Cl.
*G03G 15/16* (2006.01)

(52) U.S. Cl. ..... 399/66; 399/314

(58) Field of Classification Search ..... 399/38, 399/66, 75, 297, 310, 313, 314
See application file for complete search history.

(56) References Cited

U.S. PATENT DOCUMENTS

2007/0025753 A1* 2/2007 Saito et al. ..... 399/88

FOREIGN PATENT DOCUMENTS

| | | |
|---|---|---|
| JP | 07-064412 A | 3/1995 |
| JP | 2001-296720 | 10/2001 |
| JP | 2002-049252 | 2/2002 |

OTHER PUBLICATIONS

JP Office Action dtd Mar. 30, 2010, JP Appln. 2008-049491, English translation.

* cited by examiner

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

An image forming apparatus can include an image carrier, a transfer device, and an applying circuit, and a controller. The image carrier carries a developer image developed by developer. The transfer device transfers the developer image to a recording media. The applying circuit has an active device and applies a transfer bias voltage to the transfer device. The controller controls the applying circuit with a predetermined control signal during a start-up mode of the applying circuit and during a normal mode of the applying circuit. The normal mode is subsequent to the start-up mode. During the start-up mode of the applying circuit, the controller controls a value (a duty ratio) of the control signal (a PWM signal) with gradual increase and with interposing an interval period (τ2) between the gradual increase. A value of the control signal in the interval period does not activate the active device.

12 Claims, 11 Drawing Sheets

FIG.10

Table INFLOW CURRENT AND INITIAL Duty (Duty_In)

| INFLOW CURRENT [μA] | ~1 | ~2 | ~3 | ~4 | ~5 |
|---|---|---|---|---|---|
| ESTIMATED LOAD RESISTANCE[MΩ] | 60 | 30 | 20 | 15 | 12 |
| Duty_Plus [%] | 20 | 10 | 5 | 3 | 2 |

PRIOR ART

IMAGE FORMING APPARATUS

CROSS REFERENCE TO RELATED APPLICATION

This application claims priority from Japanese Patent Application No. 2008-049491 filed Feb. 29, 2008. The entire content of this priority application is incorporated herein by reference.

TECHNICAL FIELD

The present invention relates to an image forming apparatus. Specifically, the present invention relates to start-up of transfer bias voltage of the image forming apparatus.

BACKGROUND

It is known in the art to perform control to stepwisely increase on-duty ratio of a PWM signal and thereby slowly raise transfer voltage at a time of starting up transfer bias voltage.

However, in the art, when leak current flows from a photoreceptor to an applying circuit that generates transfer bias voltage, it is concerned that the applying circuit can be disabled to start up because of influence of the leak current. Then, with the control as is in the art, the PWM value gradually becomes larger and, therefore, the applying circuit is started up in due course. However, with such control, it is concerned that the duty ratio may be increased too much at the time of start-up thus causing over-current.

Thus, there is a need in the art for an image forming apparatus that can suitably perform start-up of the transfer bias voltage without generating over-current.

SUMMARY

One aspect of the present invention is an image forming apparatus including an image carrier configured to carry a developer image developed by developer, a transfer device configured to transfer the developer image to a recording medium, an applying circuit configured to apply a transfer bias voltage to the transfer device, the applying circuit including an active device, and a controller configured to control the applying circuit with a predetermined control signal during a start-up mode of the applying circuit and during a normal mode of the applying circuit, the normal mode being subsequent to the start-up mode. During the start-up mode of the applying circuit, the controller controls a value of the control signal with gradual increase and with interposing an interval period between the gradual increase of the value. The value of the control signal does not activate the active device in the interval period.

With this configuration, in order that the applying circuit starts to apply the transfer bias voltage, the controller controls the value of the control signal with the gradual increase and with interposing the interval period between the gradual increase of the value. The value of the control signal in the interval period does not activate the active device. Therefore, in a case where inflow current exists at a time of starting to apply the transfer bias voltage, the transfer bias voltage can be gradually increased. As a result of this, start-up can be performed with high-voltage without generating over-current (overshoot) by the applying circuit.

BRIEF DESCRIPTION OF THE DRAWINGS

FIG. 10 is a table showing relationship between inflow current and initial Duty.

DETAILED DESCRIPTION

An illustrative aspect in accordance with the present invention will be described with reference to FIGS. 1 through 10.

(General Configuration of Laser Printer)

Figure 1:
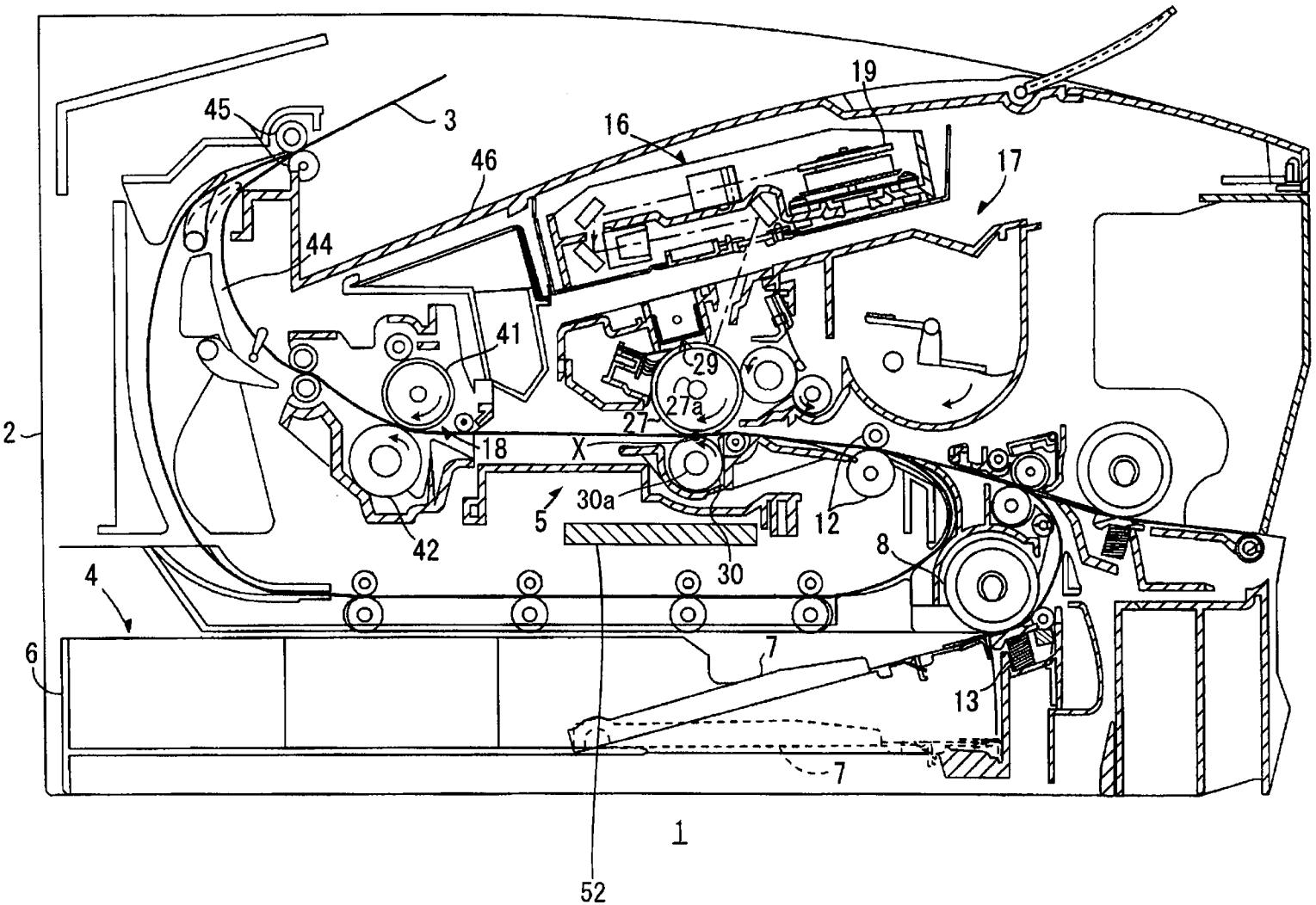
FIG. 1 is a side cross-sectional view of a printer of an illustrative aspect in accordance with the present invention.

FIG. 1 is a side cross-sectional view of a laser printer (hereinafter referred to as a "printer 1"; an illustration of an image forming apparatus). Note that, hereinafter, the right side in FIG. 1 represents the front side of the printer 1, while the left side in FIG. 1 represents the rear side of the printer 1. In FIG. 1, the printer 1 includes a body frame 2, a sheet-feeding unit 4, an image forming mechanism 5, and the like. The sheet-feeding unit 4 and the image forming mechanism are disposed in the body frame 2. The sheet-feeding unit 4 feeds each sheet 3 (an illustration of a recording media, which can be in the form of paper, plastic, and the like). The image forming mechanism 5 forms images on the fed sheets 3.

(1) Sheet-Feeding Unit

The sheet-feeding unit 4 includes a sheet-feed tray 6, a sheet-pressing plate 7, a sheet-feed roller 8, and a registration roller 12. The sheet-pressing plate 7 can pivot about a rear end portion thereof. The sheet 3 which is located at an uppermost position on the sheet-pressing plate 7 is pressed toward the sheet-feed roller 8. Then, the sheets 3 are fed one by one by rotation of the sheet-feed roller 8.

The fed sheet 3 is registered by the registration roller 12 and, thereafter, is sent to a transfer position X. Note that the transfer position X is a position where the toner image on a photosensitive drum 27 is transferred to the sheet 3. The transfer position X is a contact position of the photosensitive drum 27 (an illustration of an image carrier) with the transfer roller 30 (an illustration of a transfer device).

(2) Image Forming Mechanism

The image forming mechanism 5 includes, for example, a scanner 16, a process cartridge 17, and a fixing unit 18.

The scanner 16 includes a laser emitter (not illustrated), a polygon mirror 19, and the like. Laser beam (shown by dashed-dotted line in the figure) emitted from the laser emitter is deflected by the polygon mirror 19 and exposes a surface of the photosensitive drum 27.

The process cartridge 17 includes a developing roller 31, the photosensitive drum 27, a charger 29 (e.g. of a scorotron type), and a transfer roller 30. Note that a drum shaft 27*a* of the photosensitive drum 27 is grounded.

The charger 29 uniformly and positively charges the surface of the photosensitive drum 27. Thereafter, the surface of the photosensitive drum 27 is exposed to the laser beam emitted from the scanner 16, whereby an electrostatic latent image is formed. Next, toner carried on a surface of the developing roller 31 is supplied to the electrostatic latent image formed on the photosensitive drum 27, whereby the electrostatic latent image is developed.

The transfer roller 30 includes a metal roller shaft 30*a*. The roller shaft 30*a* is connected to an applying circuit 60 (an illustration of an applying circuit) (see FIG. 2). The applying circuit 60 is mounted on a substrate 52. At a time of transfer operation, a transfer bias voltage Va is applied from the applying circuit 60.

As the sheet 3 passes between a heat roller 41 and a pressure roller 42, the fixing unit 18 fuses the toner on the sheet 3. The sheet 3 after the fusing process is released through a sheet-exit path 44 onto a sheet-exit tray 46.

(Configuration of Applying Circuit)

Figure 2:
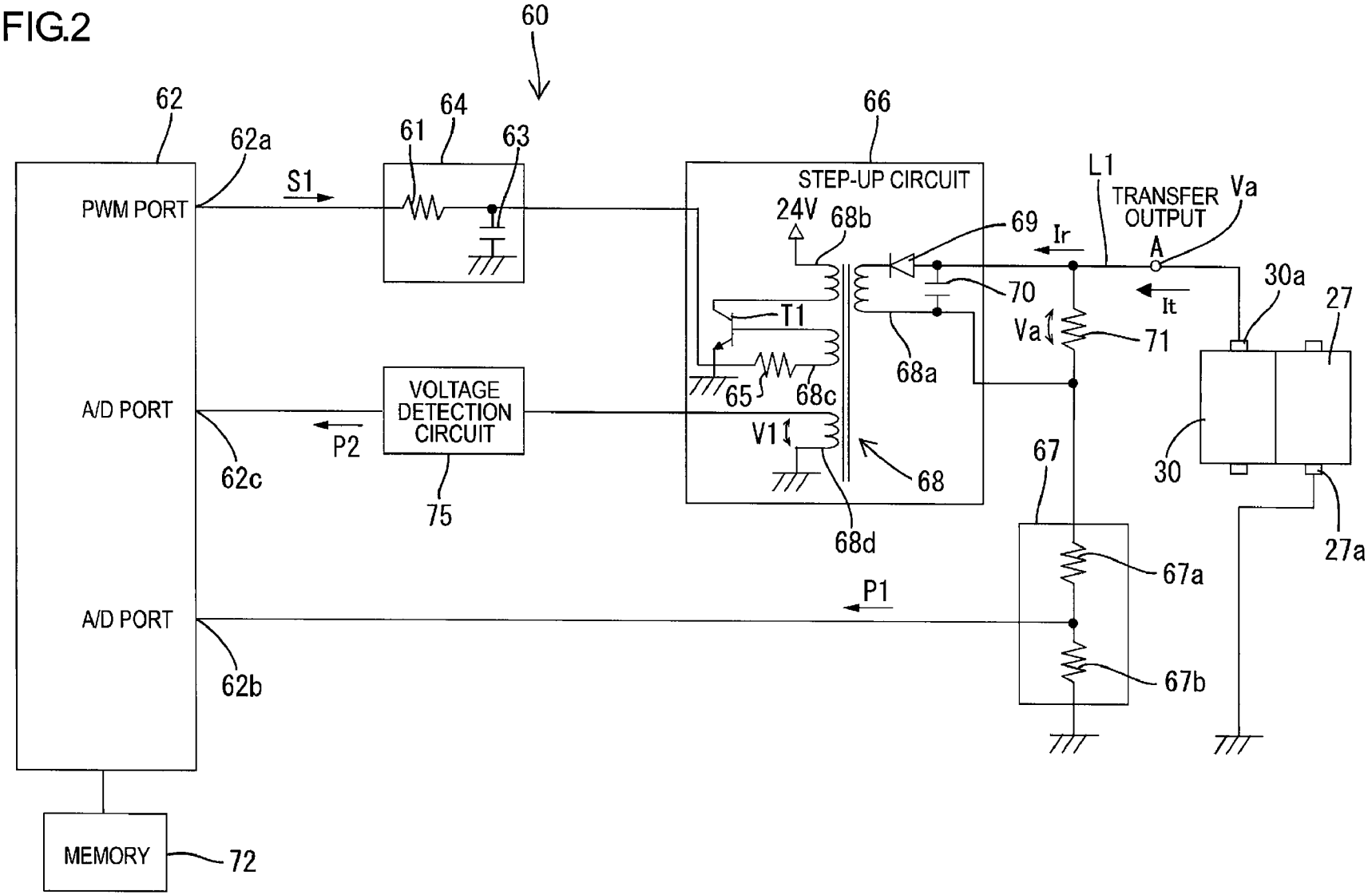
FIG. 2 is a block diagram of a configuration of an applying circuit.

FIG. 2 shows a configuration of main parts of the applying circuit 60, a control circuit 62 (an illustration of a controller), and a memory 72. The applying circuit 60 applies the transfer bias voltage Va to the transfer roller 30. Programs and the like, which can be executed by the control circuit 62, are stored in the memory 72.

The applying circuit 60 includes a smoothing circuit 64, a step-up circuit 66, a current detection circuit 67 (an illustration of an inflow-current detection circuit and a current detection circuit), and a voltage detection circuit 75 (an illustration of a voltage detection circuit).

The smoothing circuit 64 has, for example, a resistor 61 and a capacitor 63. The smoothing circuit 64 receives a PWM (Pulse Width Modulation) signal S1 (an illustration of a control signal) from a PWM port 62*a* of the control circuit 62, smoothes the PWM signal S1, and supplies the smoothed PWM signal S1 to a base of a transistor T1 through a resistor 65 and a self-excited winding 68*c* of the step-up circuit 66. Based on the supplied PWM signal S1, the transistor T1 supplies oscillation current to a primary winding 68*b* of the step-up circuit 66.

The step-up circuit 66 includes a transformer 68, a diode 69, a smoothing capacitor 70, and the like. The transformer 68 includes a secondary winding 68*a*, the primary winding 68*b*, the self-excited winding 68*c*, and an auxiliary winding 68*d*. An end of the secondary winding 68*a* is connected to the roller shaft 30*a* of the transfer roller 30 through the diode 69 and a connecting line L1. The other end of the secondary winding 68*a* is grounded through the current detection circuit 67. Furthermore, the smoothing capacitor 70 and a discharge resistor 71 are connected in parallel with each other to the secondary winding 68*a*.

Thus, the oscillation current in the primary winding 68*b* is stepped up and rectified in the step-up circuit 66, and is applied as the transfer bias voltage (for example, negative high voltage) Va to the roller shaft 30*a* of the transfer roller 30. Transfer current It flowing through the transfer roller 30 (taking a value of current that flows in the direction of an arrow in FIG. 2) then flows into resistors 67*a*, 67*b* of the current detection circuit 67, and a detection signal P1, which depends on the transfer current It, is fed back to an A/D port 62*b* of the control circuit 62.

At the time of transfer operation, the sheet 3 reaches the above-described transfer position X, and the toner image on the photosensitive drum 27 is transferred to the sheet 3. At this time, the control circuit 62 supplies the PWM signal S1 to the PWM smoothing circuit 64. This causes the transfer bias voltage Va to be applied to the roller shaft 30*a* of the transfer roller 30, which is connected to an output end A of the step-up circuit 66. Along with this, the control circuit 62 executes constant current control based on the detection signal P1, which depends on a current value of the transfer current It flowing through the connecting line L1. With the constant current control, the duty ratio (an illustration of a control signal value) of the PWM signal S1 outputted to the PWM smoothing circuit 64 is properly modulated so that the current value of the transfer current It is within a target range.

(Configuration for Measuring Load Resistance)

Next, a configuration for measuring load resistance R in the electricity supply path for supplying power to the transfer roller 30 will be described. The power supply path is the path that runs from the above-described output end A, through the transfer roller 30 and the photosensitive drum 27, and is grounded.

As shown in FIG. 2, the voltage detection circuit 75 of the applying circuit 60 is connected between the auxiliary winding 68d of the transformer 68 of the step-up circuit 66 and the control circuit 62. The voltage detection circuit 75 includes, for example, a diode and a resistor (not illustrated). At the time of transfer operation performed by the applying circuit 60, the voltage detection circuit 75 detects an output voltage v1 generated between the auxiliary winding 68*d*, and supplies a detection signal P2 to an A/D port 62*c*.

The control circuit 62 loads the detection signals P1, P2 and calculates the load resistance R of that moment of the transfer roller 30 from a current value of the transfer current It and a voltage value of the output voltage v1. Here, the transfer bias voltage Va can be estimated from relationship between the voltage value of the output voltage v1 and the number of turns of the secondary winding 68*a*, the primary winding 68*b*, and the auxiliary winding 68*d*. Then, the load resistance R can be obtained from formula 1, which is as follows (concerning the estimated transfer bias voltage Va):

$$Va=(\text{the resistor } 67a+\text{the resistor } 67b+\text{the load resistance } R)*It \qquad \text{Formula 1}$$

Here, because Va, the resistance (67*a*+67*b*), and It has been determined, the load resistance R is calculated from the formula 1. Note here that the load resistance R includes resistance of the transfer roller 30 and the photosensitive drum 27.

(Control of Start-Up Mode)

Figure 3:
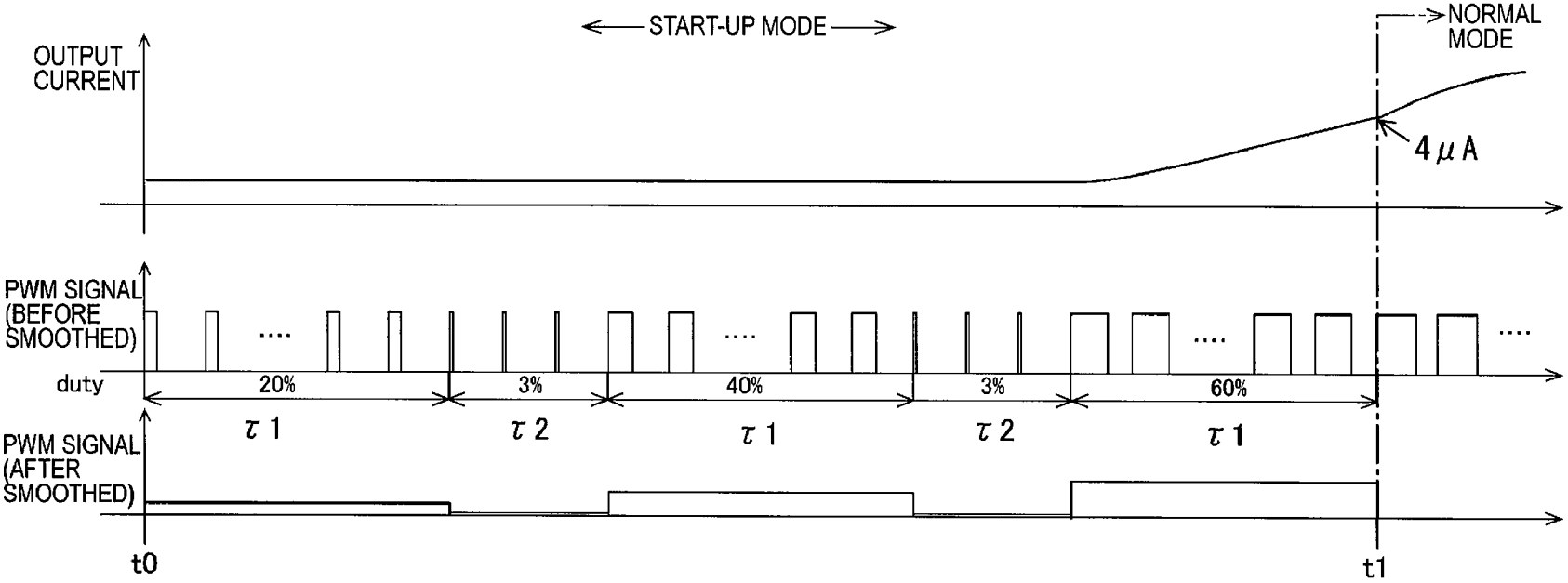
FIG. 3 is a time chart at a time of starting up the applying circuit.

Next, control at a time of starting up the applying circuit 60 (a start-up mode) will be described. FIG. 3 shows a time chart at the time of starting up the applying circuit 60. At the time of starting up the applying circuit 60, the control circuit 62 controls duty ratio of the PWM signal S1 with gradual increase and with interposing an interval period τ2 (e.g. 10 ms) between the increase of the duty ratio. Note that the value of the duty ratio in the interval period does not activate the transistor T1 of the step-up circuit 66.

Specifically, the control circuit 62 first supplies the PWM signal S1 having a duty ratio of 20% to the step-up circuit 66 a time point t0 shown in FIG. 3 for a predetermined time τ1 (e.g. 60 ms). Then, the control circuit 62 supplies the PWM signal S1 having a duty ratio of 3% to the step-up circuit 66 for a predetermined time τ2 (the interval period). This duty ratio (3%) is set as a duty ratio that does not activate the transistor T1 or, in other words, that does not turn on the transistor T1.

Note that it is only necessary for the duty ratio of the PWM signal S1 in the interval period τ2 to be properly set at the duty ratio that does not activate the transistor T1; it is not limited to "3%". For example, the duty ratio may also be "0%". In this case, the applying circuit 60 is suitably started up because, usually, the larger is the difference between the duty ratio in the interval period τ2 and the duty ratio after the interval period τ2, the easier is it to turn on the transistor T1 and thereby start up the applying circuit 60.

Next, subsequently to the interval period τ2, the control circuit 62 supplies the PWM signal S1 having a duty ratio of 40% to the step-up circuit 66 for a predetermined time T1. Next, the control circuit 62 again supplies the PWM signal S1 having the duty ratio of 3% to the step-up circuit 66 for the predetermined time τ2 (the interval period). Next, subsequently to the interval period τ2, the control circuit 62 supplies the PWM signal S1 having a duty ratio of 60% to the step-up circuit 66 for the predetermined time τ1. Then, when the control circuit 62 determines based on the detection signal P1 at, for example, a time point t1 shown in FIG. 3 that the transfer current It is larger than a predetermined value (e.g. 4 μA), the control circuit 62 ascertains normal start-up of the step-up circuit 66 is completed and, after the time point t1, performs control of a normal mode (for example, constant current control) of the step-up circuit 66.

Figure 11:
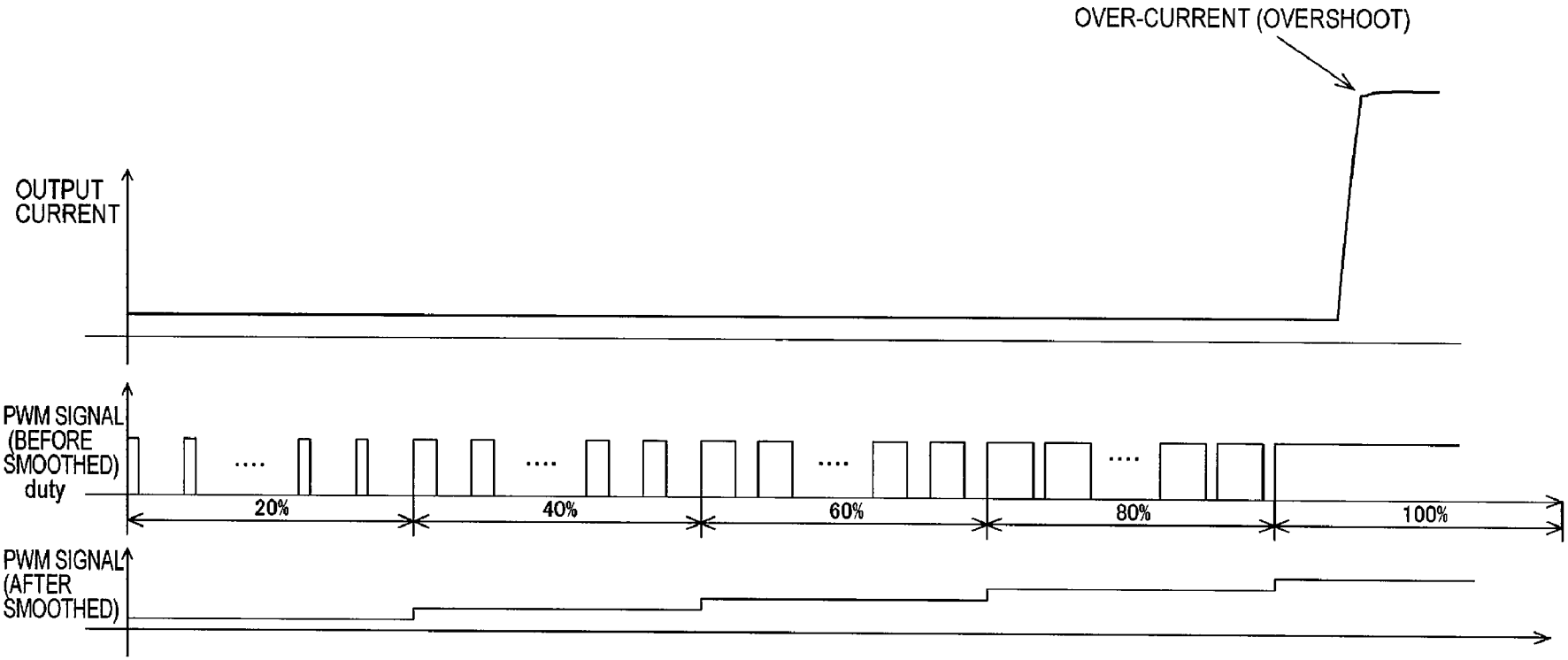
FIG. 11 is a time chart at a time of starting up in a prior art.

Thus, in this illustrative aspect, at the time of starting up the applying circuit 60, the duty ratio of the PWM signal S1 is gradually increased and, furthermore, the interval periods τ2 are provided between the increase of the duty ratio. Therefore, in a case where inflow current Ir exists, energy difference from the interval period τ2 to supply of the next PWM signal S1 contributes to drive of the transformer 68 of the step-up circuit 66, so that the applying circuit 60 can be smoothly started up. As a result of this, generation of overcurrent (overshoot) as shown in FIG. 11 can be avoided at a time of starting up the applying circuit 60.

Furthermore, the PWM signal S1 having the duty ratio that does not activate the transistor T1 is supplied to the applying circuit 60 during the interval period τ2, and thereby the capacitor 63 of the smoothing circuit 64 is charged. Therefore, when starting up the applying circuit 60, the transistor T1 can be rapidly turned on in comparison with a case where the capacitor 63 is not charged.

(Ascertainment of Start-Up)

Next, it will be illustratively described to ascertain that start-up of the applying circuit is completed by control of the above-described start-up mode in accordance with the present invention.

FIRST ILLUSTRATIVE EXAMPLE

First Example of Ascertainment Based on Transfer Voltage Value

Figure 4:
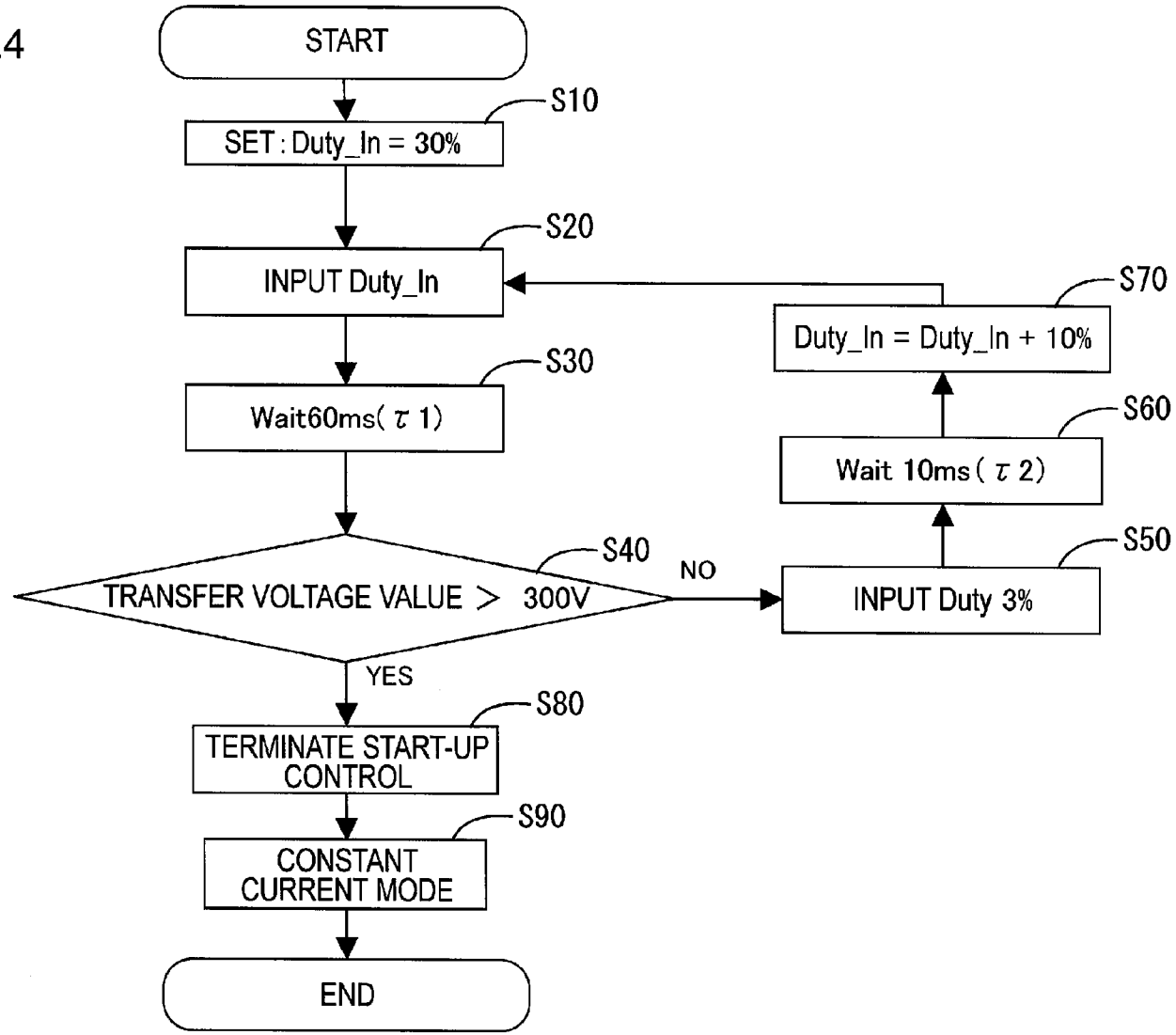
FIG. 4 is an illustrative flowchart to ascertain start-up of the applying circuit.

First, a first illustrative example of ascertainment based on the generated transfer voltage value will be described with reference to a flowchart of FIG. 4. The control shown in FIG. 4 is started by the control circuit 62 when the sheet 3 is initially supplied from the sheet-feeding unit 4 and the like. The initial supply of the sheet 3 is caused after the printer 1 is powered on or after the mode shifts from an image forming mode, which is performed with the image forming mechanism 5, to a power-saving mode for saving power consumption of the printer 1. Note that the state of feeding the sheet 3 can be detected in, for example, a conveying path wherethrough the sheet 3 is conveyed with a detection signal that is sent from a before-registration sensor (not illustrated). The before-registration sensor is provided upstream of the registration roller 12 in the sheet conveying direction.

In step S10 of the flowchart of FIG. 4, the control circuit 62 sets an initial duty ratio of the PWM signal S1 at, for example, 30%. Next, in step S20, the PWM signal S1 having the duty ratio of 30% is supplied to the applying circuit 60. Then, in step S30, the control circuit 62 waits for the predetermined time τ1 (e.g. 60 ms). That is, the PWM signal S1 having the duty ratio of 30% is supplied to the applying circuit 60 for the predetermined time period τ1 (e.g. 60 ms).

Next, the control circuit 62 determines in step S40 whether or not the transfer bias voltage value Va based on the detection signal P2 of that moment is larger than a predetermined value (e.g. 300 V). When it is determined in the step S40 that the transfer bias voltage value Va is equal to or less than 300 V, the process goes to step S50. In the step S50, the control circuit 62 supplies the PWM signal S1 having the duty ratio of 3% to the applying circuit 60 and, in step S60, waits for the predetermined time period τ2 (e.g. 10 ms). That is, the PWM signal S1 having the duty ratio of 3% is applied for the predetermined time (the interval period) τ2 (e.g. 10 ms).

Then, upon a lapse of the predetermined time (the interval period) τ2, the process goes to step S70. In the step S70, 10% is added to the duty ratio of the latest processing, so that the duty ratio is set at 40%. Next, the control circuit 62 supplies the PWM signal S1 having the duty ratio of 40% to the applying circuit 60 in the step S20, and again waits for the predetermined time τ1 (e.g. 60 ms) in the step S30. Then, when it is determined in the step S40 that the transfer bias voltage value Va is larger than 300 V, it is ascertained that start-up of the applying circuit 60 is completed, and the start-up control of the applying circuit 60 is terminated in step S80. Then, in step S90, the applying circuit 60 is controlled in the normal mode control such as, for example, at constant current. Then, after shifting from the image-forming mode to the power-saving mode, the constant current control is terminated. Thus, the present control is terminated.

Note that when the PWM signal S1 having the duty ratio of 40% is supplied to the applying circuit 60 in the step S20 and, then, it is determined in the step S40 that the transfer bias voltage value Va is equal to or less than 300 V, the process goes to the step S70. In the step S70, 10% is added to the duty ratio (40%) of the latest processing, so that the duty ratio is set at 50%. Thus, until it is determined in the step S40 that the transfer bias voltage value Va is larger than 300 V, 10% is added to the duty ratio of the latest processing, so that the applied duty ratio is gradually increased at every lapse of the predetermined time τ1.

SECOND ILLUSTRATIVE EXAMPLE

Second Example of Ascertainment Based on Transfer Voltage Value

Next, a second illustrative example of ascertainment based on the generated transfer voltage value will be described with reference to a flowchart of FIG. 5. Note that the processing identical with those of the flowchart of FIG. 4 is designated by identical step numbers, the description of which will be omitted.

Figure 5:
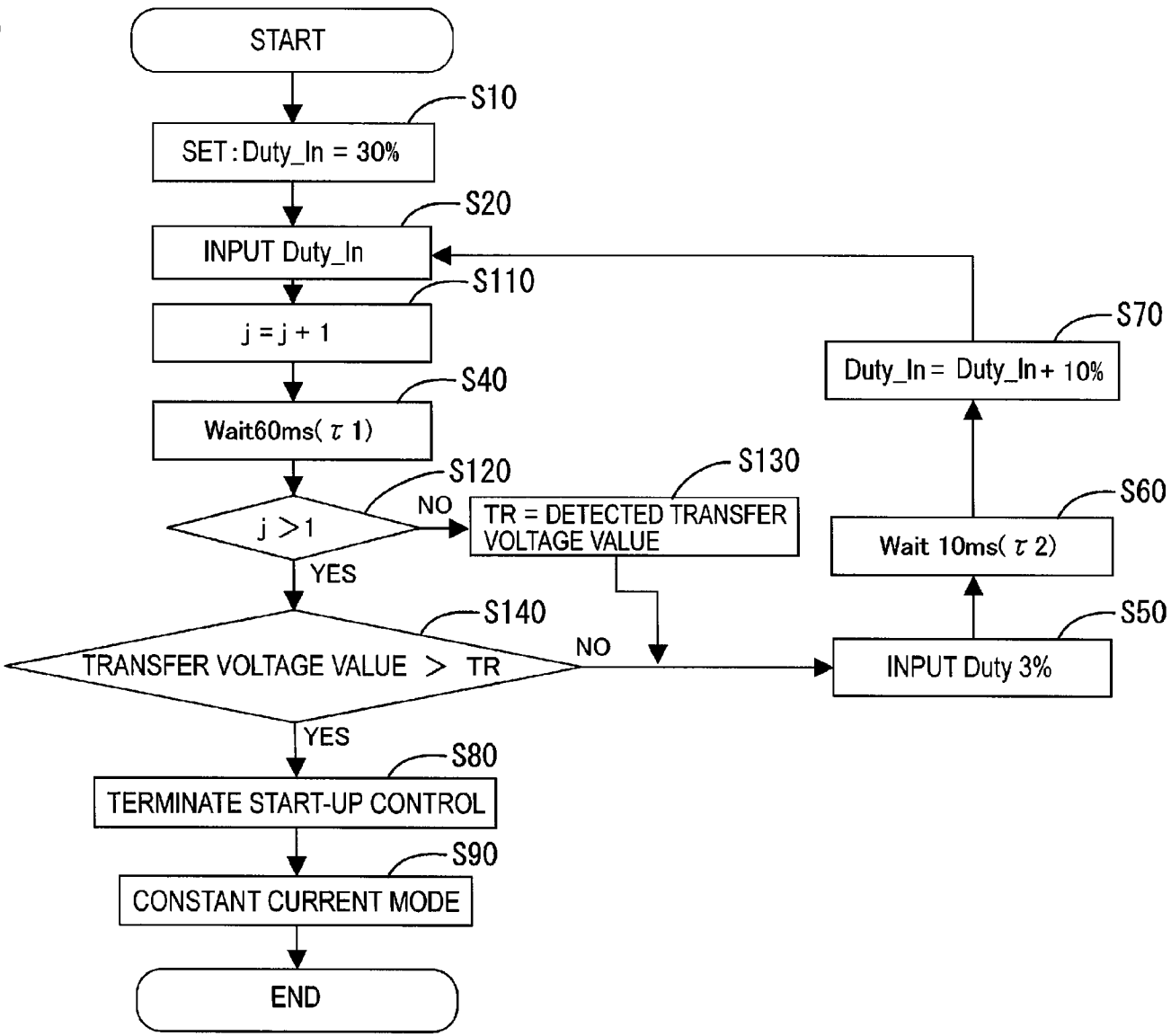
FIG. 5 is another illustrative flowchart to ascertain start-up of the applying circuit.

In step S110 of an initial processing in FIG. 5, "j=0+1=1" is executed. Then, because j is "1" in the determination processing of the step S120 of this initial processing, the process goes to step S130. In the step S130, a detected transfer voltage value, which is obtained based on the (initial) detection signal P2 of the initial processing, is set as a value of "TR". Then, when the step S120 is in the second or further processing, the process goes to step S140. In the step S140, it is determined whether or not the transfer voltage value detected in the second or further processing is larger than the transfer voltage value set as "TR" (i.e. the transfer voltage value detected in the initial processing). Then, when the transfer voltage value detected in the second or further processing is larger than the transfer voltage value detected in the initial processing, it is ascertained that start-up of the applying circuit 60 is completed and, thereafter, control as in the flow chart of FIG. 4 is performed.

Thus, in the illustrative example 2, start-up of the applying circuit 60 is ascertained only based on the condition that the transfer voltage value detected in the second or further processing is increased more than the transfer voltage value detected in the initial processing.

THIRD ILLUSTRATIVE EXAMPLE

First Example of Ascertainment Based on Transfer Current Value

Figure 6:
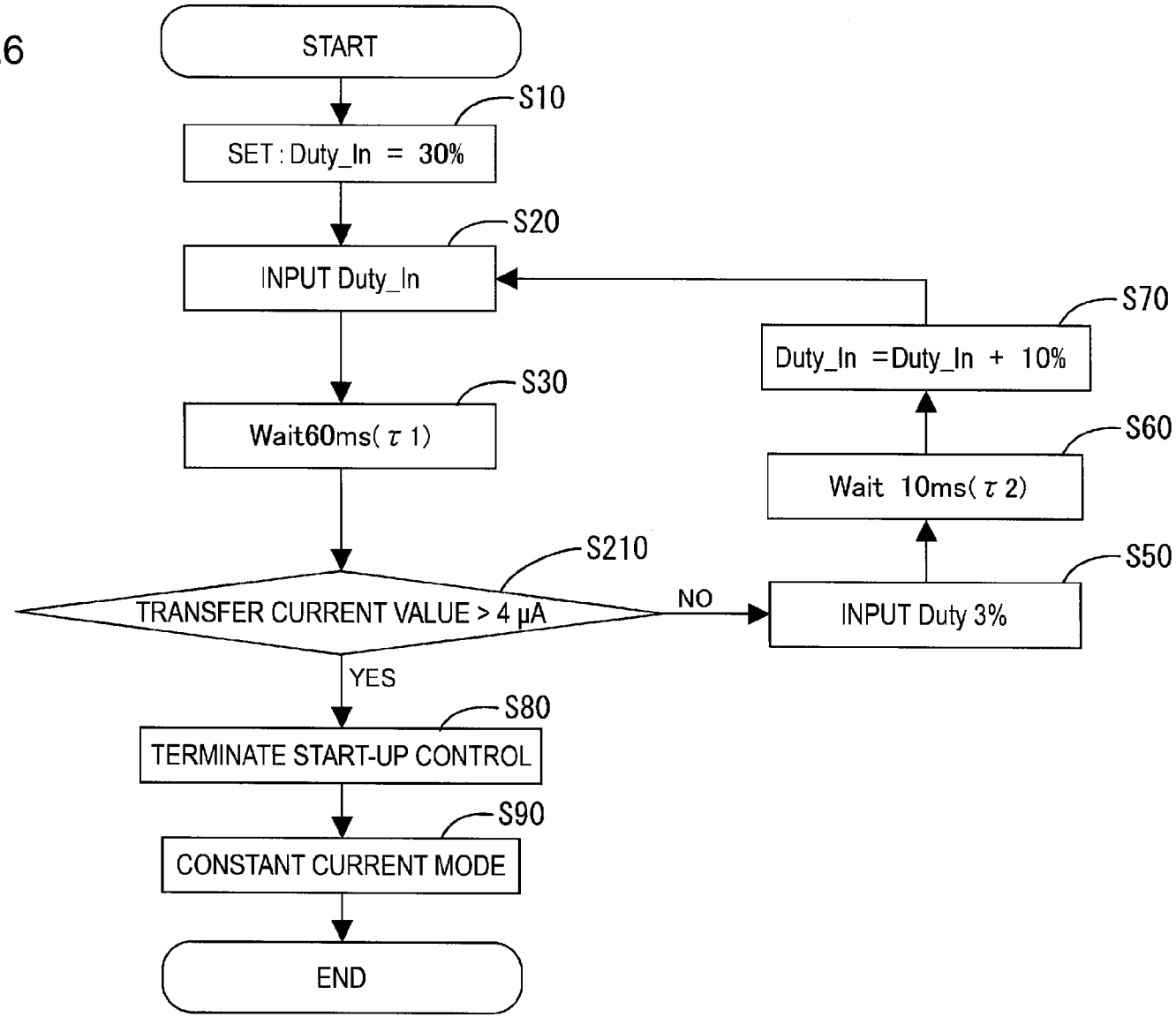
FIG. 6 is another illustrative flowchart to ascertain start-up of the applying circuit.

Next, a first example of ascertainment based on transfer current value will be described with reference to a flowchart of FIG. 6. Note that the processing identical with those of the flowchart of FIG. 4 is designated by identical step numbers, the description of which will be omitted.

The difference from the flowchart of FIG. 4 is that, in the third illustrative example, the step S40 shown in FIG. 4 is replaced with step S210 so that start-up of the applying circuit 60 is ascertained when it is determined that the transfer current value It based on the detection signal P1 is larger than 4 μA.

FOURTH ILLUSTRATIVE EXAMPLE

Second Example of Ascertainment Based on Transfer Current Value

Next, a second example of ascertainment based on transfer current value will be described with reference to a flowchart of FIG. 7. Note that the processing identical with those of the flowchart of FIG. 4 is designated by identical step numbers, the description of which will be omitted. The ascertainment of start-up of the applying circuit 60 of the fourth illustrative example is similar to the ascertainment of the second illustrative example. The difference is only that the transfer voltage value is replaced with the transfer current value.

Figure 7:
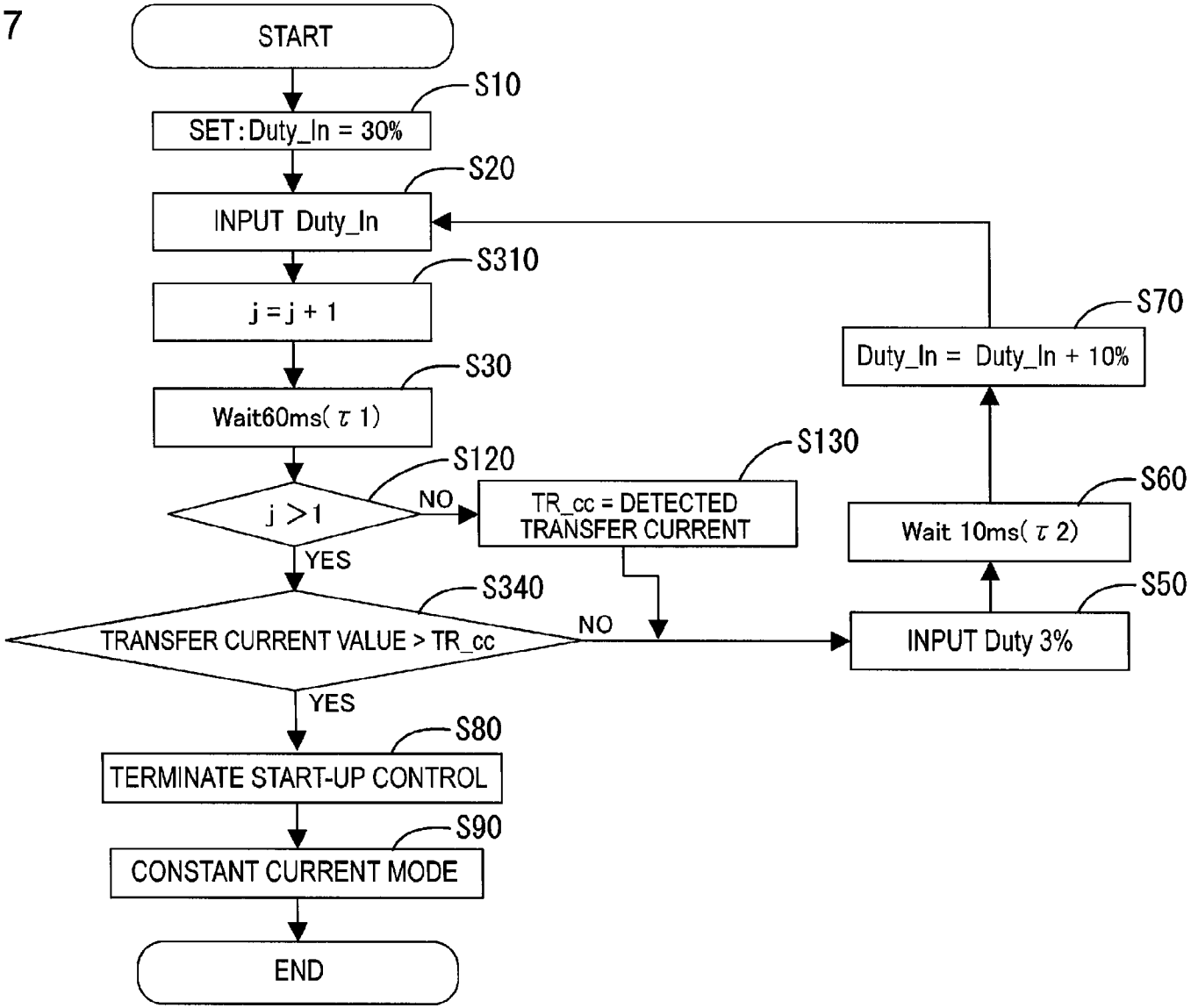
FIG. 7 is another illustrative flowchart to ascertain start-up of the applying circuit.

That is, it is determined in step S340 shown in FIG. 7 whether or not the transfer current value detected in the second or further processing is larger than the transfer current value set as "TR_cc" (i.e. the (initial) transfer current value detected in the initial processing). Then, when the transfer current value detected in the second or further processing is larger than the transfer current value detected in the initial processing, it is ascertained that start-up of the applying circuit 60 is completed. Accordingly, thereafter, control similar to that in the flow chart of FIG. 4 is performed.

Thus, in the illustrative example 4, start-up of the applying circuit 60 is ascertained only based on the condition that the transfer current value detected in the second or further processing is increased more than the transfer current value detected in the initial processing.

FIFTH ILLUSTRATIVE EXAMPLE

First Example of Ascertainment Based on Comparison of Inflow Current with Transfer Current Next, a first example of ascertainment based on comparison of the inflow current Ir with the transfer current It will be described with reference to a flowchart of FIG. 8. Note that the processing identical with those of the flowchart of FIG. 4 is designated by identical step numbers, the description of which will be omitted.

Figure 8:
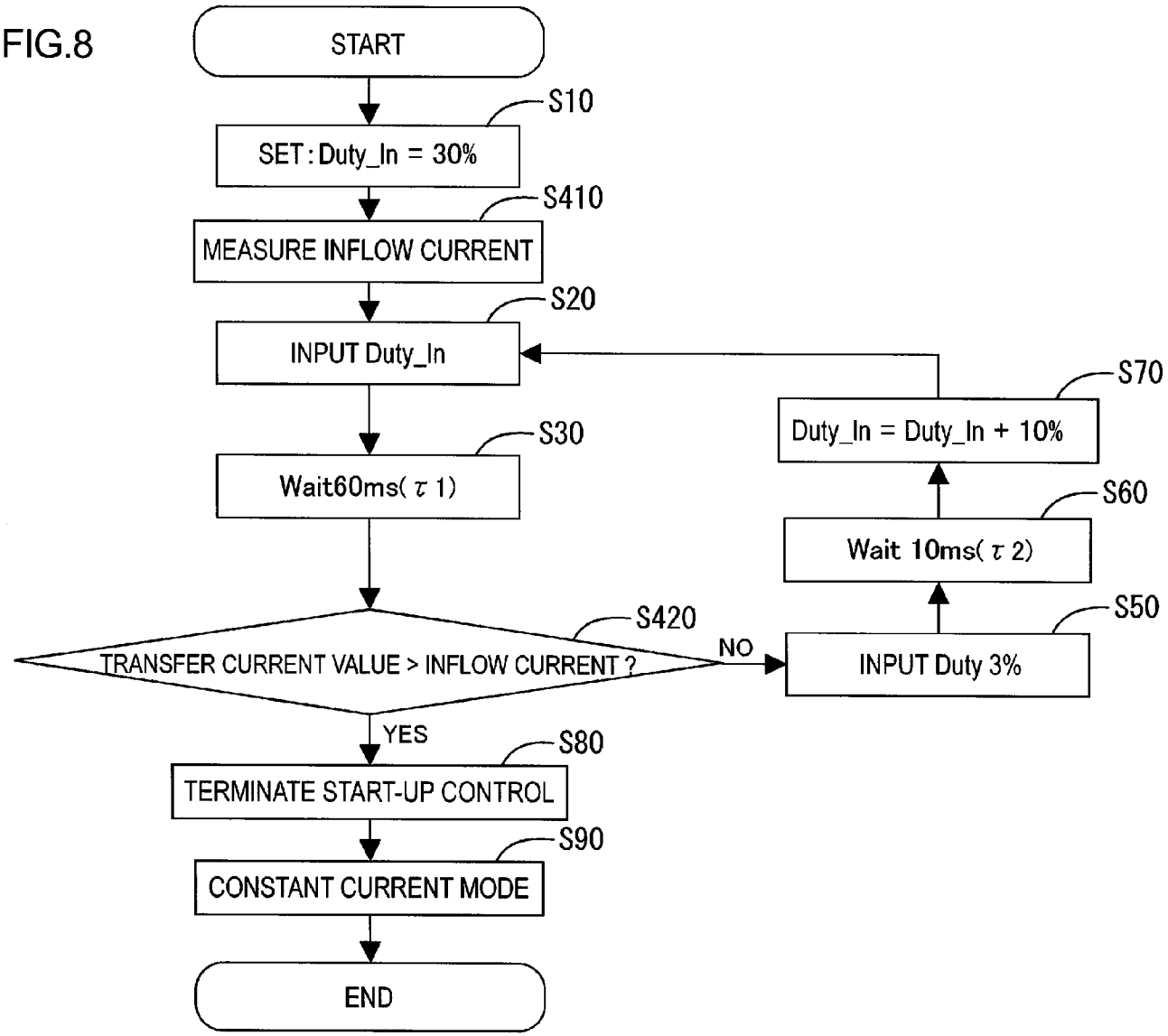
FIG. 8 is another illustrative flowchart to ascertain start-up of the applying circuit.

In the fifth illustrative example, the difference from the flowchart of FIG. 4 is that the inflow current Ir is detected in step S410 shown in FIG. 8 using the current detection circuit 67, and it is determined in step S420 whether or not a value of the transfer current It is larger than the value of the inflow current Ir. Then, when the transfer current It is larger than the inflow current Ir, it is ascertained that start-up of the applying circuit 60 is completed. Accordingly, thereafter, control similar to that in the flowchart of FIG. 4 is performed.

When a normal raise of the applying voltage is completed by the applying circuit 60, a transfer current It that is larger than the inflow current Ir is thereby obtained. Therefore, in the fifth illustrative example, start-up of the applying circuit 60 is ascertained by determining amounts of the transfer current It and the inflow current Ir.

SIXTH ILLUSTRATIVE EXAMPLE

Second Example of Ascertainment Based on Comparison of Inflow Current with Transfer Current Next, a second example of ascertainment based on comparison of the inflow current Ir with the transfer current It will be described with reference to a flowchart of FIG. 9. Note that the processing identical with those of the flowchart of FIG. 4 is designated by identical step numbers, the description of which will be omitted.

Figure 9:
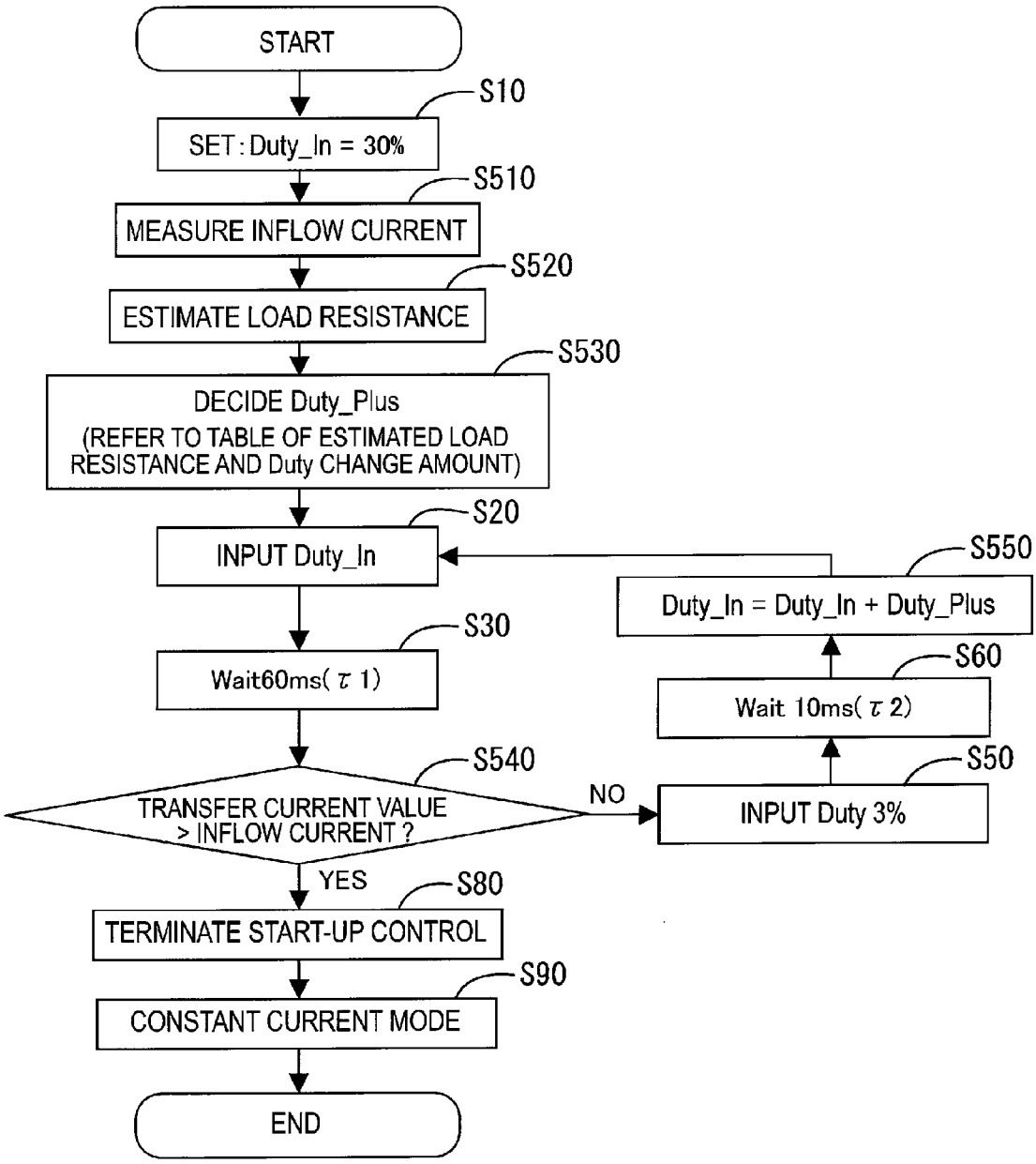
FIG. 9 is another illustrative flowchart to ascertain start-up of the applying circuit.

In the sixth illustrative example, the difference from the flowchart of FIG. 4 is that the inflow current Ir is detected in step S510 shown in FIG. 9 using the current detection circuit 67 and, in step S520, the load resistance value R is estimated from the detected inflow current Ir. The load resistance value R is estimated based on, for example, a table shown in FIG. 10 (see FIG. 10). This table can be prepared in advance by experiments or the like, and can be stored in the memory 72 connected to the control circuit 62.

Next, in step S530, an additional duty ratio (Duty_Plus) is decided. The decision of the additional duty ratio (Duty_Plus) is made, for example, based on the table of FIG. 10.

Then, in step S540, as in the fifth illustrative example, ascertainment of start-up of the applying circuit 60 is made by comparison of the value of the inflow current Ir with the value of the transfer current It. That is, when the transfer current value is larger than the inflow current value, it is ascertained that start-up of the applying circuit is completed and, thereafter, control similar to that in the flowchart of FIG. 4 is performed. On the other hand, when the transfer current It is equal to or less than the inflow current Ir, the additional duty ratio (Duty_Plus) is added to the duty ratio of the latest processing in step S550.

Thus, in the sixth illustrative example, the additional duty ratio (Duty_Plus) is changed according to the load resistance R. This is because the transfer current It is more difficult to flow as the load resistance R is higher and, therefore, it is rather preferable to change the additional duty ratio (Duty_Plus) according to the load resistance R in order to more suitably start up the applying circuit 60.

<Other Illustrative Aspects>

The present invention is not limited to the illustrative aspect as described above with reference to the drawings. For example, the following illustrative aspects are also included within the scope of the present invention.

(1) In the second illustrative example of ascertainment of start-up, start-up of the applying circuit 60 is ascertained illustratively when the value of the transfer bias voltage Va is larger than the (initial) detected transfer voltage TR of the initial processing. The present invention is not limited to this.

For example, start-up of the applying circuit 60 may be ascertained when the value of the transfer bias voltage Va of that processing is larger than the detected transfer voltage of the previous processing such as the latest processing or the further previous processing.

Likewise, in the fourth illustrative example, start-up of the applying circuit 60 is ascertained illustratively when the value of the transfer current It is larger than the (initial) detected transfer current TR_cc of the initial processing. The present invention is not limited to this. For example, start-up of the applying circuit 60 may be ascertained when the value of the transfer current It in that processing is larger than the detected transfer current of the previous processing such as the latest processing or the further previous processing.

(2) In the above illustrative aspects, the step-up circuit 66 is illustratively a self-excited flyback type having the transformer 68. The type of the step-up circuit 66 is not limited to this. For example, the step-up circuit 66 may also be a separately-excited flyback type, a separately-excited forward type, or the like.

(3) In the above illustrative aspect, the control signal is illustrated as the PWM signal, and the value of the control signal is illustrated as the duty ratio of the PWM signal. The present invention is not necessarily limited to this. For example, the control signal and the value of the control signal may be a DC signal and a voltage value of the DC signal, respectively. In this case, the smoothing circuit 64 is unnecessary.

(4) In the above illustrative aspect, the duty ratio to be added to the duty ratio of the latest processing in the step S70 is illustratively fixed at 10%. The present invention is not limited to this. For example, the duty ratio to be added may be changed at every processing of execution of the step S70, or the duty ratio to be added may be changed at every two processing of execution of the step S70.

(5) In the above illustrative aspect, the interval period $\tau 2$ is illustrated to be, for example, constantly 10 ms. The present invention is not limited to this. For example, the interval period $\tau 2$ maybe changed so as to be gradually shortened. Furthermore, while the duty ratio of the interval period $\tau 2$ is illustrated to be constantly 3%, the duty ratio maybe changed during an interval period $\tau 2$, or also may be changed on an interval period $\tau 2$ basis.

(6) Illustrated in the above illustrative aspect is the case where constant current control of the transfer current It is performed in the normal mode. The present invention can be adopted also to a case where constant voltage control of the transfer bias voltage Va is performed in the normal mode.

(7) In the above illustrative aspect, the "image forming apparatus" includes a monochromatic printer and a two (or more) color printer. Furthermore, the "image forming apparatus" includes not only a printing apparatus such as the printer (for example, the laser printer) or the like; the "image forming apparatus" may include also a multi-function machine having a printer function, a read function (a scanner function), a facsimile, and the like.

The image forming apparatus may include an inflow-current detection circuit configured to detect inflow current flowing into the applying circuit through the transfer device from the image carrier. The controller controls the applying circuit so that the larger is the inflow current, the lower is a start-up voltage of the transfer bias voltage.

Usually, it is estimated that the larger is the inflow current, the lower is load resistance. Therefore, since the larger is the inflow current, the larger is the output current depending on PWM signal having a certain duty ratio, by controlling in the above manner, high-voltage start-up can be performed without generating over-current.

The image forming apparatus may further include an inflow-current detection circuit configured to detect inflow current flowing into the applying circuit through the transfer device from the image carrier, and a calculation circuit configured to calculate load resistance using the inflow current. The controller controls the applying circuit so that the lower is the load resistance, the lower is a start-up voltage of the transfer bias voltage.

With the configuration as above, high-voltage start-up can be performed correspondingly to the value of the load resistance and without generating over-current.

The controller of the image forming apparatus may control an increasing amount for gradually increasing the value of the control signal to make the increasing amount smaller for the start-up voltage of the transfer bias voltage to be lower.

The controller of the image forming apparatus may control an initial value of the value of the control signal to make the initial value smaller for the start-up voltage of the transfer bias voltage to be lower.

With these configurations, the larger is the inflow current, or the lower is the load resistance, the start-up voltage of the transfer bias voltage can be more desirably reduced. As a result of this, high-voltage start-up can be performed without generating over-current.

What is claimed is:

1. An image forming apparatus comprising:

an image carrier configured to carry a developer image developed by a developer;

a transfer device configured to transfer the developer image to a recording medium;

an applying circuit configured to apply a transfer bias voltage to the transfer device, the applying circuit including an active device; and a controller configured to control the applying circuit with a predetermined control signal during a start-up mode of the applying circuit and during a normal mode of the applying circuit, the normal mode being subsequent to the start-up mode;

wherein the control signal is a PWM signal, wherein during the start-up mode of the applying circuit, the controller sets a first duty ratio of the PWM signal for a first term and a second duty ratio of the PWM signal for a second term, the second duty ratio being larger than the first duty ratio, wherein an interval period is interposed subsequent to the first term, the second term being subsequent to the interval period, the controller setting a third duty ratio of the PWM signal for the interval period, the third duty ratio being larger than zero and smaller than both the first duty ratio and the second duty ratio, and wherein the PWM signal with the third duty ratio does not activate the active device in the interval period.

2. The image forming apparatus according to claim 1 further comprising:

an inflow-current detection circuit configured to detect inflow current flowing into the applying circuit through the transfer device from the image carrier;

wherein:

the controller controls the applying circuit so that the larger the inflow current, the lower a start-up voltage of the transfer bias voltage.

3. The image forming apparatus according to claim 2, wherein:

the controller controls an increasing amount for setting a duty ratio of the PWM signal to make the increasing amount smaller for the start-up voltage of the transfer bias voltage to be lower.

4. The image forming apparatus according to claim 2, wherein:

the controller controls an initial duty ratio of the PWM signal to make the initial duty ratio smaller for the start-up voltage of the transfer bias voltage to be lower.

5. The image forming apparatus according to claim 1 further comprising:

an inflow-current detection circuit configured to detect inflow current flowing into the applying circuit through the transfer device from the image carrier; and a calculation circuit configured to calculate load resistance using the inflow current;

wherein:

the controller controls the applying circuit so that the lower the load resistance, the lower a start-up voltage of the transfer bias voltage.

6. The image forming apparatus according to claim 1 further comprising:

a detection circuit configured to detect start-up of the applying circuit;

wherein:

the controller detects the start-up of the applying circuit based on a result of detection performed by the detection circuit.

7. The image forming apparatus according to claim 6, wherein:

the detection circuit includes a voltage detection circuit configured to detect an output voltage of the applying circuit; and when the output voltage detected by the voltage detection circuit is larger than a predetermined value, the controller detects the start-up of the applying circuit.

8. The image forming apparatus according to claim 6, wherein:

the detection circuit includes a voltage detection circuit configured to detect an output voltage of the applying circuit; and when the output voltage detected by the voltage detection circuit at a present time of increase of the PWM signal value is larger than the output voltage detected by the voltage detection circuit at a previous time of increase of a duty ratio of the PWM signal, the controller detects the start-up of the applying circuit.

9. The image forming apparatus according to claim 8, wherein:

the previous time of increase of the duty ratio of the PWM signal is a time of setting an initial duty ratio of the PWM signal.

10. The image forming apparatus according to claim 6, wherein:

the detection circuit includes a current detection circuit configured to detect an output current of the applying circuit; and when the output current detected by the current detection circuit is larger than a predetermined value, the controller detects the start-up of the applying circuit.

11. The image forming apparatus according to claim 6, wherein:

the detection circuit includes a current detection circuit configured to detect an output current of the applying circuit; and when the output current detected by the current detection circuit at a present time of increase of a duty ratio of the PWM signal is larger than the output current detected by the current detection circuit at a previous time of increase of the duty ratio of the PWM signal, the controller detects the start-up of the applying circuit.

12. The image forming apparatus according to claim 6, wherein:

the detection circuit includes a current detection circuit configured to detect an output current of the applying circuit; and when the output current detected by the current detection circuit is larger than an inflow current, the controller detects the start-up of the applying circuit.

* * * * *